US005166030A

United States Patent [19]

Ono et al.

[11] Patent Number: 5,166,030

[45] Date of Patent: Nov. 24, 1992

[54] ELECTROSTATIC IMAGE-DEVELOPING TONER CONTAINING A QUATERNARY AMMONIUM CHARGE CONTROLLING AGENT

[75] Inventors: Hitoshi Ono, Yokohama; Osamu Ando, Kawasaki; Masako Takeuchi, Yokohama, all of Japan

[73] Assignee: Mitsubishi Kasei Corporation, Tokyo, Japan

[21] Appl. No.: 757,211

[22] Filed: Sep. 10, 1991

[30] Foreign Application Priority Data

Sep. 12, 1990 [JP] Japan ..... 2-242043
Dec. 13, 1990 [JP] Japan ..... 2-402016
Apr. 3, 1991 [JP] Japan ..... 3-071236

[51] Int. Cl.[5] ..... G03G 9/08
[52] U.S. Cl. ..... 430/110; 430/106.6
[58] Field of Search ..... 430/110, 106.6, 108

[56] References Cited

U.S. PATENT DOCUMENTS 4,937,157 6/1990 Haack et al. ..... 430/110
4,965,158 10/1990 Gruber et al. ..... 430/106.6
4,980,258 12/1990 Aoki ..... 430/110

FOREIGN PATENT DOCUMENTS 0242420 10/1987 European Pat. Off. .
0321363 6/1989 European Pat. Off. .
2359440 2/1978 France .

*Primary Examiner*—John Goodrow
*Attorney, Agent, or Firm*—Oblon, Spivak, McClelland, Maier & Neustadt

[57] ABSTRACT

An electrostatic image-developing toner comprising at least a resin and a colorant, which contains at least one member selected from the group consisting of compounds of the following formulas (I) and (II):

(I)

(II)

wherein each of $R^1$, $R^2$, $Ar^1$ and $Ar^2$ is a substituted or unsubstituted alkyl group, or a substituted or unsubstituted aralkyl group, and A is (B) $(SO_3^{\ominus})_2$ or $MX_6^{2\ominus}$, wherein B is (wherein each of $R^3$ and $R^4$ is a hydrogen atom, an alkyl group, a hydroxyl group or an amino group), M is a titanium atom, a zirconium atom or a silicon atom, and X is a fluorine atom, a chlorine atom or a bromine atom.

15 Claims, 1 Drawing Sheet

☆ : Example 25 (Compound 12)

□ : Example 26 (Compound 29)

Figure 1:
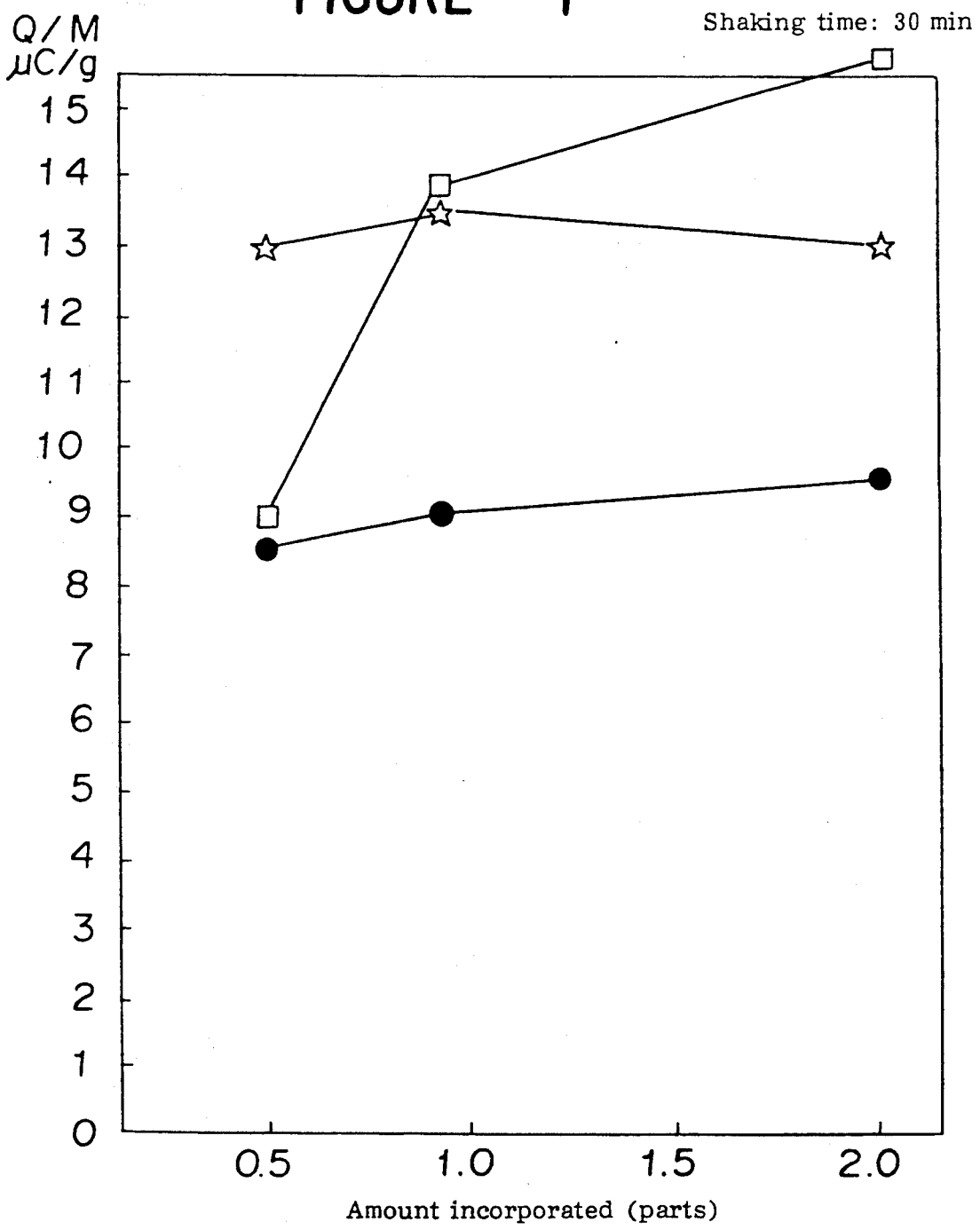

● : Comparative Example 2 (Compound A)

ELECTROSTATIC IMAGE-DEVELOPING TONER CONTAINING A QUATERNARY AMMONIUM CHARGE CONTROLLING AGENT

The present invention relates to an electrostatic image-developing toner useful for e.g. electrophotographic copying machines.

In its developing step, a developer useful for e.g. electrophotographic copying machines, is first deposited on an image support such as a photoreceptor having an electrostatic image formed thereon. Then, it is transferred in a transfer step from the photoreceptor to a transfer paper and then fixed on a copy sheet in a fixing step. As the developer for developing an electrostatic image formed on a latent image-maintaining surface, a two component developer comprising a carrier and a toner, and an one component developer (a magnetic toner) which requires no carrier, are known for this purpose.

Further, as an agent for imparting electric charge to a developer, a Nigrosine dye, a charge controlling agent such as a quaternary ammonium salt or a coating agent for carrier, has been known. For example, Japanese Unexamined Patent Publications No. 119364/1982 (which corresponds to U.S. Pat. No. 4,338,390), No. 169857/1985 and No. 54/1989 (which corresponds to EP 284000A) disclose quaternary ammonium salts as charge controlling agents.

However, these conventional charge-imparting agents are not necessarily adequate in their charge-imparting effects and have a problem that the charge-imparting effects tends to change with time and copy staining tends to result by continuous copying, whereby the copying quality tends to deteriorate.

Under these circumstances, the present inventors have conducted extensive researches to present an electrostatic image-developing toner of high quality which is less likely to bring about copy staining even when time passes. As a result, they have found it possible to solve such problems by incorporating a compound having a certain specific structure into the toner. The present invention has been accomplished on the basis of this discovery.

Namely, the present invention provides an electrostatic image-developing toner comprising at least a resin and a colorant, which contains at least one member selected from the group consisting of compounds of the following formulas (I) and (II):

(I)

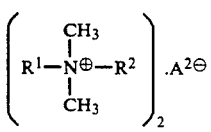

(II)

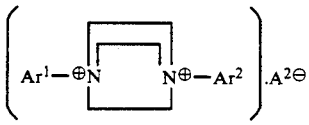

wherein each of $R^1$, $R^2$, $Ar^1$ and $Ar^2$ is a substituted or unsubstituted alkyl group, or a substituted or unsubstituted aralkyl group, and A is $(B)(SO_3\ominus)_2$ or $MX_6{}^{2\ominus}$, wherein B is

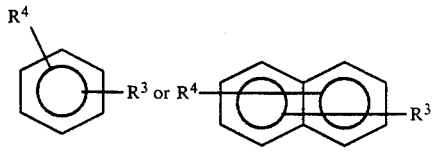

(wherein each of $R^3$ and $R^4$ is a hydrogen atom, an alkyl group, a hydroxyl group or an amino group), M is a titanium atom, a zirconium atom or a silicon atom, and X is a fluorine atom, a chlorine atom or a bromine atom.

The accompanying drawing, FIG. 1 is a graph showing the relation between the amount of a charge-controlling agent incorporated and the quantity of charge imparted to a toner, wherein symbol ☆ represents Example 25, symbol □ represents Example 26, and ● represents Comparative Example 2.

Now, the present invention will be described in detail with reference to the preferred embodiments.

The electrostatic image-developing toner of the present invention is characterized in that it contains at least one member selected from the group consisting of compounds of the above formulas (I) and (II).

In the formula (II),

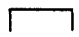

represents

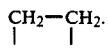

Accordingly

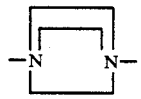

represents

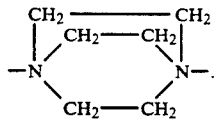

The same applies hereinafter.

Specifically, each of $R^1$ and $R^2$ may be an alkyl group such as a methyl group, an ethyl group, a propyl group, an isopropyl group, a n-butyl group, a pentyl group, a hexyl group, a heptyl group, an octyl group, a nonanyl group, a decyl group, an undecyl group, a dodecyl group, a tridecyl group, a tetradecyl group, a pentadecyl group, a hexadecyl group, a heptadecyl group or an octadecyl group; an aralkyl group such as a benzyl group; or a substituted aralkyl group such as a lower alkyl-substituted benzyl group, a nitro-substituted benzyl group or a halogen-substituted benzyl group. Among them, a dodecyl group, a tetradecyl group, a hexadecyl group, an octadecyl group, a benzyl group or a substituted benzyl group is preferred. The sum of the carbon members of $R^1$ and $R^2$ is preferably at least 13, more preferably at least 19, most preferably at least 30.

Each of $Ar^1$ and $Ar^2$ which are independent from each other, is an alkyl group such as a methyl group, an ethyl group, a propyl group, an isopropyl group, a n-butyl group, an isobutyl group, a pentyl group, a hexyl group, a heptyl group, an octyl group, a nonanyl group, a decyl group, an undecyl group, a dodecyl group, a tridecyl group, a tetradecyl group, a pentadecyl group, a hexadecyl group, a heptadecyl group or an octadecyl group; an aralkyl group such as a benzyl group; or a substituted aralkyl group such as a lower alkyl-substituted benzyl group, a nitro-substituted benzyl group or a halogen-substituted benzyl group. Particularly preferred is a heptyl group, a decyl group, a dodecyl group, a tetradecyl group, a hexadecyl group, an octadecyl group, a benzyl group or a substituted benzyl group. The sum of the carbon numbers of $Ar^1$ and $Ar^2$ is preferably at least 13, more preferably at least 19, and most preferably at least 30.

Each of $R^3$ and $R^4$ is a hydrogen atom, an alkyl group, a hydroxyl group or an amino group. Particularly preferred is a hydrogen atom, a hydroxyl group or an amino group.

M is a titanium atom, a zirconium atom or a silicon atom. Particularly preferred is a titanium atom or a zirconium atom. X is a fluorine atom, a chlorine atom or a bromine atom. Particularly preferred is a fluorine atom.

Compounds having the following structural formulas may be mentioned as specific examples of the compounds of the formulas (I) and (II) suitable for incorporation to the electrostatic image-developing toner of the present invention. However, compounds of the formulas (I) and (II) useful in the present invention are not limited to such specific examples.

Compound of the formula (I)

(1)

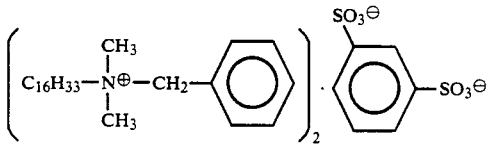

(2)

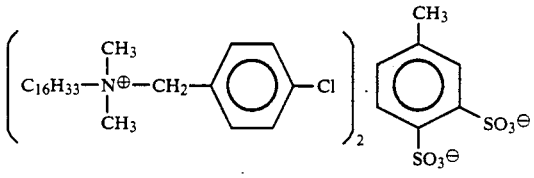

(3)

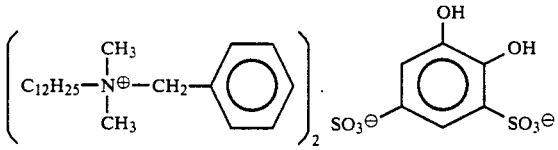

(4)

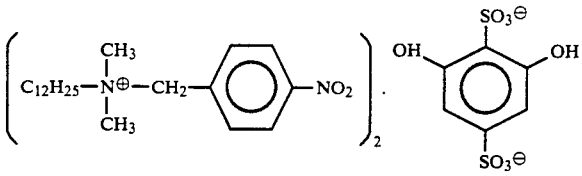

(5)

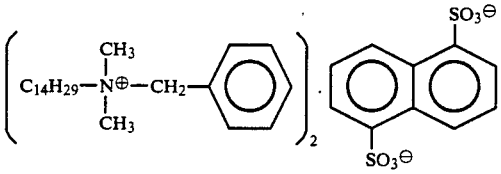

(6)

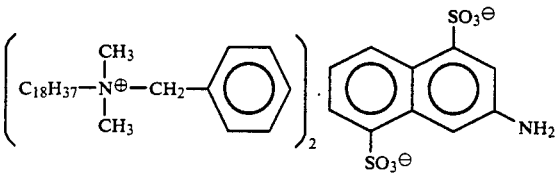

-continued
(7)
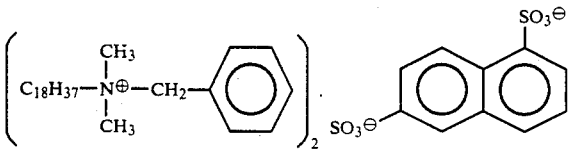
(8)
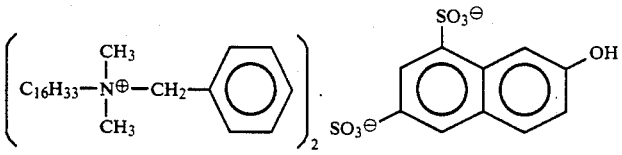
(9)
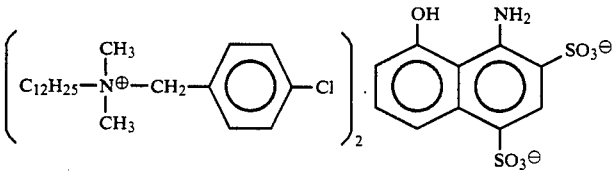
(10)
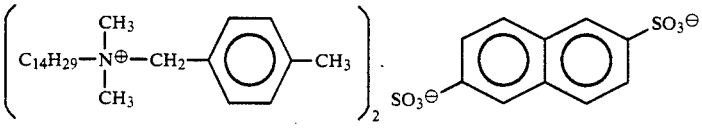
(11)
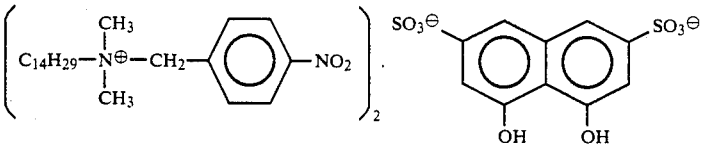
(12)
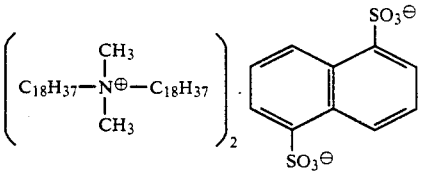
(13)
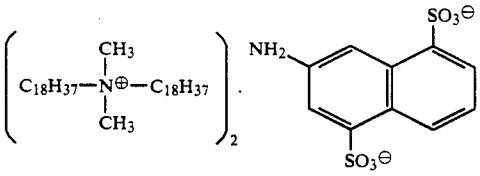
(14)
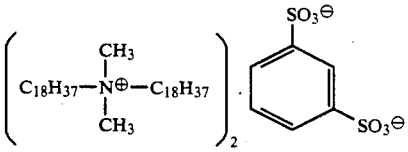
(15)
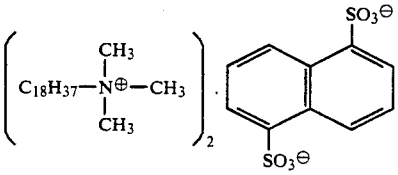

-continued
(16)
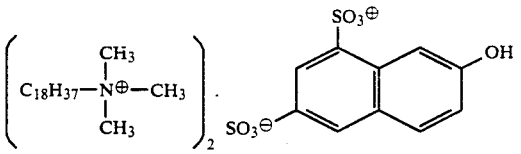
(17)
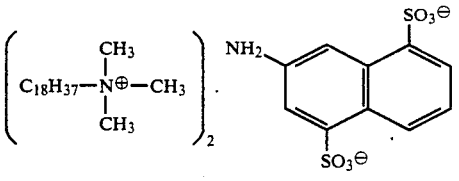
(18)
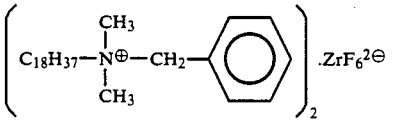
(19)
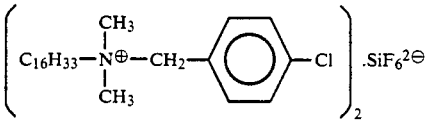
(20)
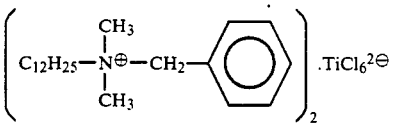
(21)
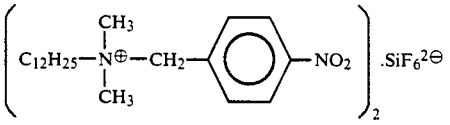
(22)
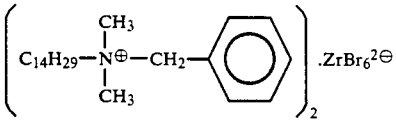
(23)
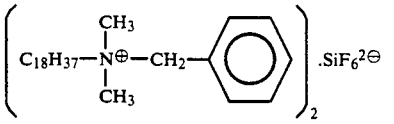
(24)
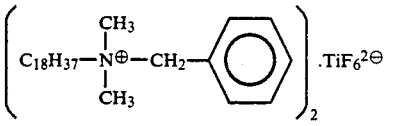
(25)
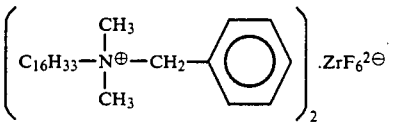

-continued
(26)
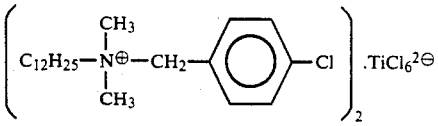
(27)
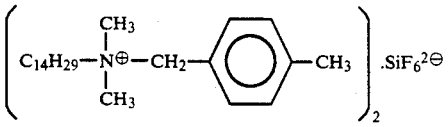
(28)
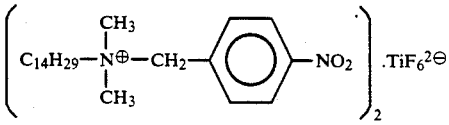
(29)
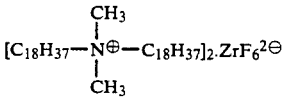
(30)
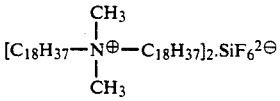
(31)
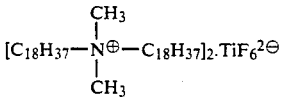
(32)
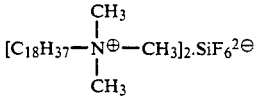
(33)
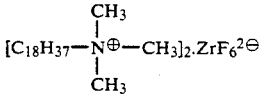
(34)
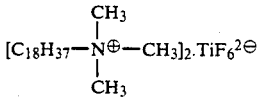
Compounds of the formula (II)
(35)
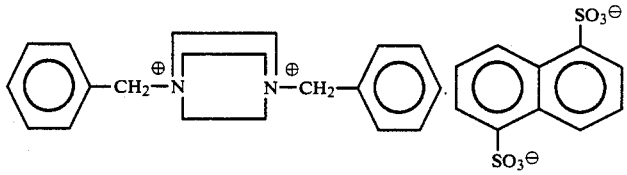
(36)
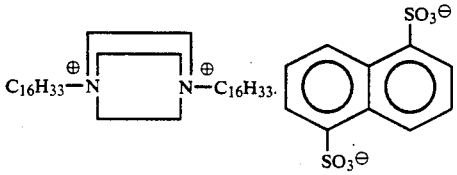

-continued
(37)
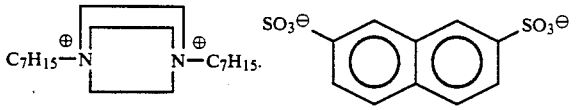
(38)
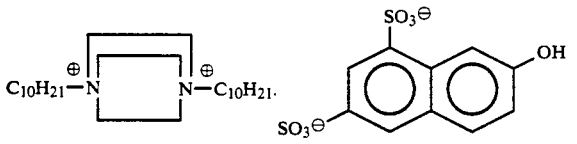
(39)
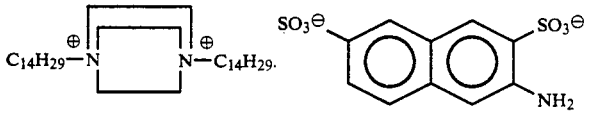
(40)
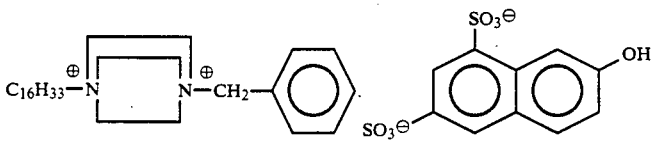
(41)
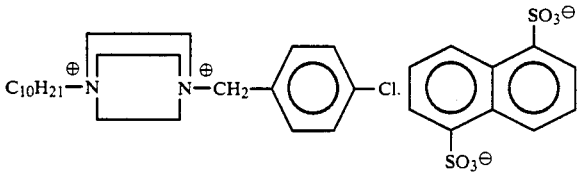
(42)
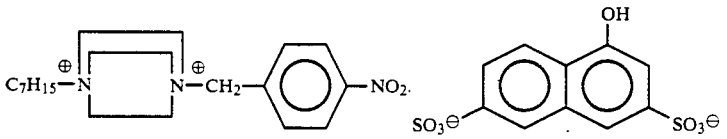
(43)
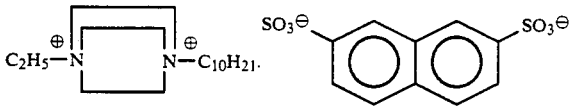
(44)
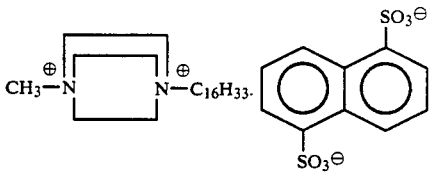
(45)
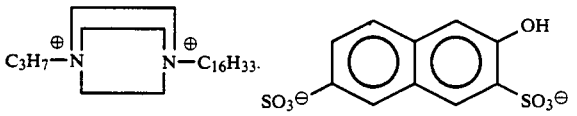
(46)
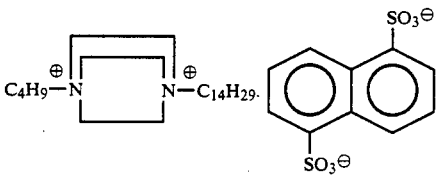

-continued
(47)
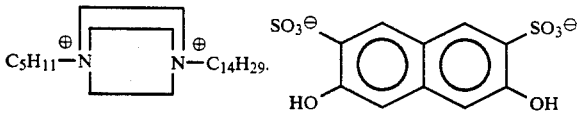
(48)
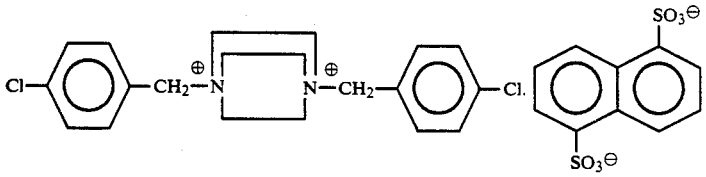
(49)
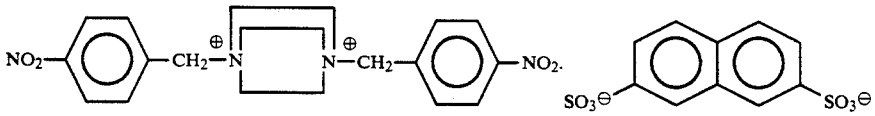
(50)
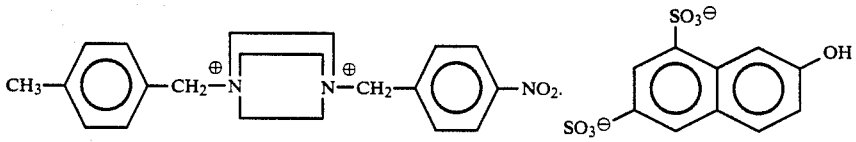
(51)
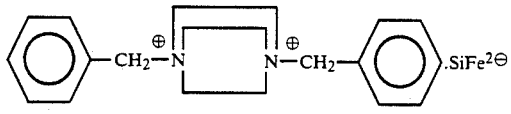
(52)
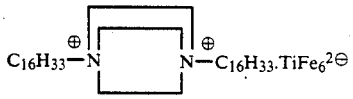
(53)
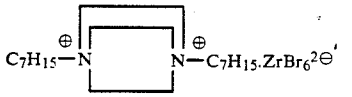
(54)
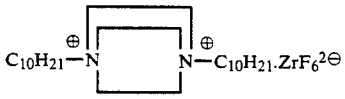
(55)
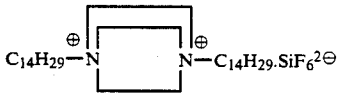
(56)
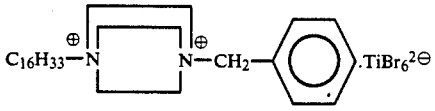
(57)
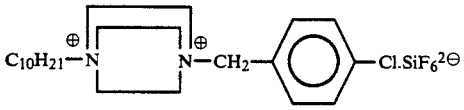
(58)
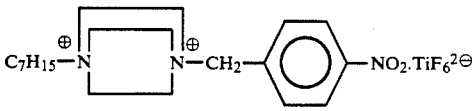

-continued (59)

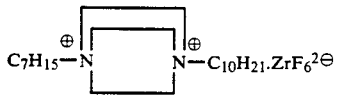

(60)

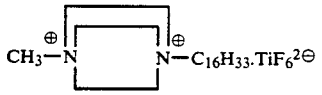

(61)

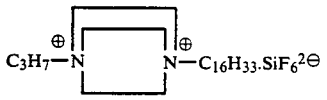

(62)

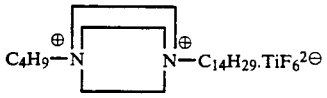

(63)

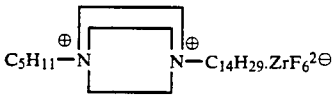

(64)

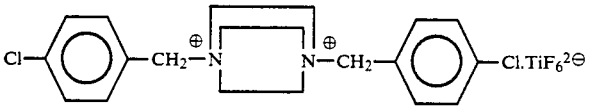

(65)

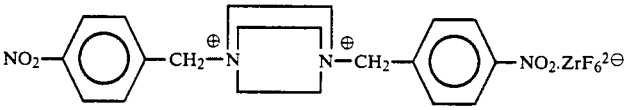

(66)

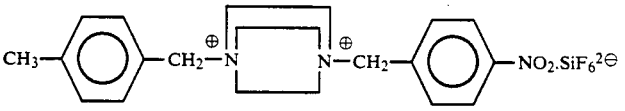

A compound of the formula (I) or (II) can be used for the present invention irrespective of the process for its production. However, an example of a specific process will be described below.

The compound of the formula (I) can usually be obtained by reacting e.g. a halogenated quaternary ammonium salt of the following formula (IV):

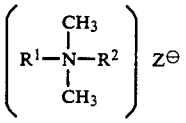

(IV)

wherein $R^1$ and $R^2$ are as defined above with respect to the formula (I), and $Z^{\ominus}$ is a halogen atom such as chlorine or bromine, with a compound of the following formula (V) or (VI) in water or in an alcohol under heating to a temperature of about 70° C.

$$(B)(SO_3Y)_2 \quad (V)$$

$$Y_2MX_6 \quad (VI)$$

wherein B, M and X are as defined above with respect to the formula (I), and Y is an alkali metal such as sodium or potassium.

The cation component in the formula (II) can be prepared usually by reacting e.g. a halogenated compound of the following formula (VII):

$$Ar'Y \quad (VII)$$

wherein Ar' is the same as $Ar^1$ and $Ar^2$ in the formula (II), and Y is a halogen atom such as chlorine or bromine, with triethylenediamine in an organic solvent inert to the reaction such as a dimethyl formamide or N-methylpyrrolidone under heating to a temperature of about 70° C. for a period of e.g. 24 hours.

The resin for the toner of the present invention may be selected from a wide range including known resins. For example, a styrene resin (a homopolymer or a copolymer of styrene or a substituted styrene) such as polystyrene, chloropolystyrene, poly-α-methyl styrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (such as a styrene-methyl acrylate copolymer, a styrene-ethyl acrylate copolymer, a styrene-butyl acrylate copolymer, a styrene-octyl acrylate copolymer or a styrene-phenyl acrylate copolymer), a styrene-methacrylate copolymer (such as styrene-methyl methacrylate copolymer, a styrene-ethyl methacrylate copolymer, a styrene-butyl methacrylate copolymer or a styrene-phenyl methacrylate copolymer), a styrene-methyl α-chloroacrylate copolymer, or a styrene-acrylonitrileacrylate copolymer, a vinylchloride resin, a rosin-modified maleic acid resin, a phenol resin, an epoxy resin, a polyester resin, a low molecular weight polyethylene, a low molecular weight polypropylene, an ionomer resin, a polyurethane resin, a silicone resin, a ketone resin, an ethylene-ethyl acrylate copolymer, a xylene resin, or a polyvinyl butyral resin, may be mentioned. Particularly preferred as the resin to be used in the present invention, is a styrene-acrylate copolymer, a styrene-methacrylate copolymer, a saturated or unsaturated polyester resin or an epoxy resin.

These resins may be used alone or in combination as a mixture of two or more of them.

The content of the compound of the formula (I) or (II) in the toner is preferably from 0.1 to 20 parts by weight, more preferably from 0.2 to 10 parts by weight, per 100 parts by weight of the resin.

If the content of the compound the formula (I) or (II) is too small, no adequate effects for improving the electric charge will be obtained. On the other hand, if the content is too large, the quality of the toner tends to deteriorate, such being undesirable.

The colorant to be used in the present invention is not particularly limited so long as it is the one which has been commonly employed. To obtain a black color toner, carbon black may, for example, be used. The compound of the formula (I) or (II) is usually white and thus may be incorporated to a colored toner such as a blue, red or yellow toner. In such a case, a colorant composed of a dye or pigment having the corresponding color, is employed.

The content of the colorant is preferably from 3 to 20 parts by weight, per 100 parts by weight of resin.

Further, in addition to the compound of the formula (I) or (II), other charge-controlling agents including known agents such as Nigrosine dyes, quaternary ammonium salts and polyamine resins may be incorporated to the toner of the present invention.

Further, an additive such as a low molecular weight olefine polymer or fine powder silica may be incorporated in order to improve the fixing property or flowability, as a constituting component of the toner of the present invention.

The toner may be prepared by a method which comprises kneading the above mentioned respective components by e.g. a kneader, followed, by, cooling, and then by pulverization and classification. The toner of the present invention may be applied not only to a two component developer but also to a so-called one component developer (a magnetic toner) such as a capsulated toner, a polymer toner or a magnetite-containing toner.

The average particle size of the toner is preferably from 5 to 20 μm. There is no particular restriction as to the carrier to be mixed with the toner of the present invention to form a developer. However, such a carrier is preferably a ferrite or magnetite carrier having an average particle size of from 10 to 200 μm. Further, there is no particular restriction as to the particle size. In such a case, a so-called coating carrier having a fluorine resin coated for the purpose of improving the durability for continuous use, may also be used. Further, other known carriers including iron powder, may also be employed. Such a carrier is used preferably in an amount of from 5 to 100 parts by weight per part by weight of the toner.

Now, the present invention will be described in further detail with reference to Examples. However, it should be understood that the present invention is by no means restricted to such specific Examples. In the following Examples, "parts" means "parts by weight" unless otherwise specified.

EXAMPLE 1

| | |
|---|---|
| Styrene resin (SBM-600, tradename, manufactured by Sanyo Kasei K.K.) | 100 parts |
| Carbon black (#44, manufactured by Mitusbishi Kasei Corporation) | 10 parts |
| Compound (1) | 2 parts |

The above materials were blended and kneaded, followed by pulverization and classification to obtain a black toner having an average particle size of 11 μm.

Five parts of this toner and 100 parts of a fluorine resin-coating carrier having an average particle size of about 100 μm were mixed and stirred to obtain a developer. Then, using this developer, a copy was taken by a copying machine employing an organic photoconductor as a photoreceptor, whereby a clear copy free from so-called fogging, i.e. free from a stain on a blank portion, was obtained.

EXAMPLES 2 to 24

In each Example, the operation was conducted in the same manner as in Example 1 except that a compound specified in the following Table 1 was used in an amount specified in Table 1 instead of 2 parts of compound (1), whereby a clear copy was obtained as in Example 1.

COMPARATIVE EXAMPLE 1

A developer was prepared in the same manner as in Example 1 except that compound (1) was not used as the material, and it was used for copying, whereby a copy of poor copy quality with substantial fogging was obtained.

TABLE 1

| | Compund No. | Parts |
|---|---|---|
| Example 2 | (5) | 2 |
| Example 3 | (8) | 3 |
| Example 4 | (12) | 2 |
| Example 5 | (16) | 2 |
| Example 6 | (18) | 2 |
| Example 7 | (23) | 2 |
| Example 8 | (24) | 3 |
| Example 9 | (29) | 2 |
| Example 10 | (30) | 2 |
| Example 11 | (31) | 2 |
| Example 12 | (32) | 5 |
| Example 13 | (33) | 4 |
| Example 14 | (34) | 6 |
| Example 15 | (36) | 2 |
| Example 16 | (39) | 5 |
| Example 17 | (43) | 4 |
| Example 18 | (44) | 6 |
| Example 19 | (46) | 3 |
| Example 20 | (49) | 3 |
| Example 21 | (50) | 2 |
| Example 22 | (62) | 3 |
| Example 23 | (65) | 3 |

TABLE 1-continued

| | Compund No. | Parts |
|---|---|---|
| Example 24 | (66) | 2 |

Comparative Test 1 in the electric charge as compared with a conventional charge-controlling agent

EXAMPLE 25

| | |
|---|---|
| Styrene-acrylate resin (G-10, tradename, manufactured by Nipppon Carbide K.K.) | 100 parts |
| Carbon black (MA-100, tradename, manufactured by Mitsubishi Kasei Corporation) | 6 parts |

To the above materials, compound (12) was blended and kneaded in an amount of 0.5 part, 1 part or 2 parts, followed by pulverization and classification to obtain a black toner having an average particle size of 10 μm.

Then, 3.5 parts of this toner and 100 parts of a silicone resin-coating ferrite carrier having an average particle size of about 100 μm were mixed to obtain a two component developer, and the quantity of charge imparted was measured by a blow off method, whereby the characteristic as shown in FIG. 1 was obtained.

EXAMPLE 26

A developer was prepared in the same manner as in Example 25 except that compound (29) was used instead of compound (12) as the charge-controlling agent, and the quantity of charge imparted thereto was measured by a blow off method, whereby the characteristic as shown in FIG. 1 was obtained.

COMPARATIVE EXAMPLE 2

A developer was prepared in the same manner as in Example 25 except that compound (A)

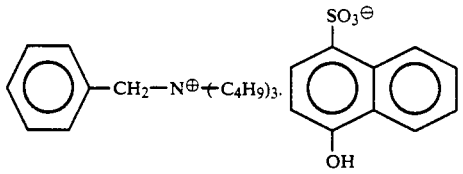

was used instead of compound (12), and the quantity of charge imparted thereto was measured by a blow off method, whereby the characteristic as shown in FIG. 1 was obtained.

Comparative Test 2 in the electric charge as compared with a conventional charge-controlling agent

EXAMPLE 27

To 100 parts of a styrene acrylate resin (SA-302, tradename, Nippon Carbide K.K.), 1 part of compound (12) was mixed by a mixer to let it deposit on the polymer surface to obtain a pseudo-toner. This pseudo-toner was shaken with an iron powder carrier for 30 minutes at a toner concentration of 1%, whereupon the quantity of charge imparted was measured by a blow off method and found to be +48 μC/g.

EXAMPLE 28

The operation was conducted in the same manner as in Example 27 except that compound (29) was used instead of compound (12) as the charge-controlling agent, whereupon the quantity of charge imparted was measured and found to be +40 μC/g.

COMPARATIVE EXAMPLE 3

The operation was conducted in the same manner as in Example 27 except that compound (B) $(C_{16}H_{33}-{}_2N^{\oplus}(CH_3)_2.\frac{1}{4}[MO_8O_{26}]^{4\oplus}$ was used instead of compound (12) as the charge-controlling agent, whereupon the quantity of charge imparted was measured and found to be +18 μC/g.

COMPARATIVE EXAMPLE 4

The operation was conducted in the same manner as in Example 27 except that compound (A)

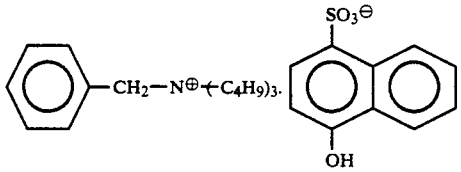

was used instead of compound (12) as the charge-controlling agent, whereupon the quantity of charge imparted was measured and found to be +18 μC/g.

The electrostatic image-developing toner containing a compound having a specific structure of the present invention, is superior in the electric charge characteristics to conventional toners, and it is an electrostatic image-developing toner of high quality, which does not bring about e.g. copy staining even by continuous copying operation.

We claim:

1. An electrostatic image-developing toner comprising at least a resin and a colorant, and contains at least one member selected from the group consisting of compounds of formulas (I) and (II):

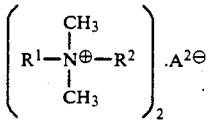

(I)

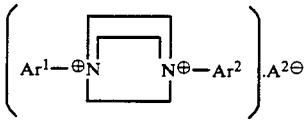

(II)

wherein each of $R^1$, $R^2$, $Ar^1$ and $Ar^2$ is a substituted or unsubstituted alkyl group, or a substituted or unsubstituted aralkyl group, and A is $(B)(SO_3\Theta)_2$ or $MX_6{}^{2}\Theta$, wherein B is

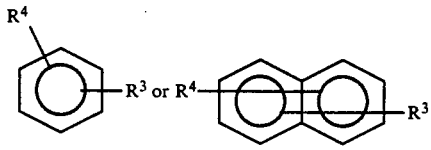

wherein each of $R^3$ and $R^4$ is a hydrogen atom, an alkyl group, a hydroxyl group or an amino group, M is a titanium atom, a zirconium atom or a silicon atom, and X is a fluorine atom, a chlorine atom or a bromine atom.

2. The electrostatic image-developing toner according to claim 1, wherein A is $(B)\text{--}(SO_3\ominus)_2$.

3. The electrostatic image-developing toner according to claim 2, wherein B is

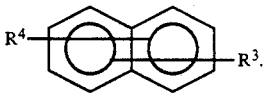

4. The electrostatic image-developing toner according to claim 3, wherein $R^3$ or $R^4$ is a hydrogen atom, an amino group or a hydroxyl group.

5. The electrostatic image-developing toner according to claim 3, wherein A is 1,5-naphthalenedisulfonate.

6. The electrostatic image-developing toner according to claim 1, wherein A is $MX_6^{2\oplus}$.

7. The electrostatic image-developing toner according to claim 6, wherein M is a titanium atom or a zirconium atom, and X is a fluorine atom.

8. The electrostatic image-developing toner according to claim 6, wherein M is a zirconium atom, and X is a fluorine atom.

9. The electrostatic image-developing toner according to claim 1, wherein said at least one member is present in an amount of from 0.1 to 20 parts by weight per 100 parts by weight of the resin.

10. The electrostatic image-developing toner according to claim 1, wherein the resin is a styrene resin or a styrene-acrylate copolymer resin.

11. The electrostatic image-developing toner according to claim 1, wherein each of $R^1$, $R^2$, $Ar^1$ and $Ar^2$ is a substituent selected from the group consisting of a methyl group, an ethyl group, a propyl group, an isopropyl group, a n-butyl group, an isobutyl group, a pentyl group, a hexyl group, a heptyl group, an octyl group, a nonanyl group, a decyl group, an undecyl group, a dodecyl group, a tridecyl group, a tetradecyl group, a pentadecyl group, a hexadecyl group, a heptadecyl group, an octadecyl group, a benzyl group, a lower alkyl-substituted benzyl group, a nitro-substituted benzyl group and a halogen-substituted benzyl group.

12. The electrostatic image-developing toner according to claim 1, wherein at least one of $R^1$ and $R^2$, and at least one of $Ar^1$ and $Ar^2$, are substituents selected from the group consisting of a heptyl group, a decyl group, a dodecyl group, a tetradecyl group, a hexadecyl group, a octadecyl group, a benzyl group, a lower alkyl-substituted benzyl group, a nitro-substituted benzyl group and a halogen-substituted benzyl group.

13. The electrostatic image-developing toner according to claim 1, wherein the sum of the carbon numbers of $R^1$ and $R^2$, and the sum of the carbon numbers of $Ar^1$ and $Ar^2$, are at least 13, respectively.

14. The electrostatic image-developing toner according to claim 1, wherein the sum of the carbon numbers of $R^1$ and $R^2$, and the sum of the carbon numbers Of $Ar^1$ and $Ar^2$, are at least 19, respectively.

15. The electrostatic image-developing toner according to claim 1, wherein the sum of the carbon numbers of $R^1$ and $R^2$, and the sum of the carbon numbers of and $Ar^2$, are at least 30, respectively.

* * * * *